US005511890A

United States Patent [19]

Momose

[11] Patent Number: 5,511,890

[45] Date of Patent: Apr. 30, 1996

[54] METHOD AND APPARATUS FOR CONTROLLING THE MOVEMENT OF A PRINTING HEAD IN A PRINTER

[75] Inventor: Hiroaki Momose, Nagano, Japan

[73] Assignee: Seiko Epson Corporation, Tokyo, Japan

[21] Appl. No.: 298,340

[22] Filed: Aug. 30, 1994

[30] Foreign Application Priority Data

Aug. 30, 1993 [JP] Japan ..... 5-214102
Jul. 4, 1994 [JP] Japan ..... 6-152303

[51] Int. Cl.[6] ..... B41J 19/30

[52] U.S. Cl. ..... 400/323; 400/279

[58] Field of Search ..... 400/323, 279, 400/320

[56] References Cited

U.S. PATENT DOCUMENTS 4,761,085 8/1988 Angst ..... 400/323
5,044,796 9/1991 Lund ..... 400/323
5,288,156 2/1994 Hori ..... 395/102
5,290,110 3/1994 Takahashi ..... 395/102

*Primary Examiner*—Edgar S. Burr
*Assistant Examiner*—Steven S. Kelley
*Attorney, Agent, or Firm*—Sughrue, Mion, Zinn, Macpeak & Seas

[57] ABSTRACT

In a method and an apparatus of controlling the movement of a printing head in a printer for printing characters along a print pass while selectively reversing the moving direction of the printing head, in which the character heights of a plurality of character series are checked, image data of a plurality of lines are read out, the image data being contained in a pass which can be printed within the height of the printing head, are printed at once. It is then checked whether or not the printed image data is continuous to the image data of the next pass, the same moving direction of the printing head is kept for printing the image of the next pass if it is continuous, and the moving direction of the printing head is reversed for printing the image of the next pass if it is not continuous. The method and the apparatus can print characters in excess of the height of the printing head with a high quality.

8 Claims, 8 Drawing Sheets

| m | Pt [ ] | Pb [ ] |
|---|---|---|
| 0 | P0t | P0b |
| 1 | P1t | P1b |
| 2 | P2t | P2b |
| . . . . . | . . . . . | . . . . . |

METHOD AND APPARATUS FOR CONTROLLING THE MOVEMENT OF A PRINTING HEAD IN A PRINTER

BACKGROUND OF THE INVENTION

The present invention relates to a serial printer, and more particularly to a method and apparatus for controlling the movement of a printing head of a printer of the type which prints characters while reciprocally moving the printing head.

In the serial printer which prints characters while moving the printing head along character lines, a print speed is increased by using both the forward and backward movements of the printing head for printing. When this bidirectional printing method is used to print an enlarged character higher than the height of the printing head through a plural number of scans by the printing head and at least one vertical feed of a recording paper, which corresponds in length to the print width, a resulting printed image can be discontinuous at the boundary of the scan zone due to mechanical error of the printer. Accordingly, its image quality is poor.

In printing such a character divided into zones for printing, deterioration of the print quality can be prevented by moving the printing head in one direction (e.g., left to right) during printing.

This type of a printer is disclosed in Unexamined Japanese Patent Publication No. Sho. 61-57348.

FIG. 11 is an illustration that facilitates understanding of the print control, viz., the movement of a printing head and the paper feed control in such a conventional printer. As shown, a series of enlarged characters "A B C" are printed on the m-th line, and another series of characters of standard size "h i j k" are printed on the n-th line spaced by a distance l from the m-th line.

In a first step of the print control, a carriage carrying the printing head is first moved in one direction (e.g., from left to right). Through the movement of the carriage, the upper half of the enlarged character series, "A B C", is printed on a line. Then, a recording paper is fed by the distance l. In a second step, the standard character series, "h i j k", is printed. Thereafter the recording paper is fed by a distance of (H–l).

Subsequently, the lower half of the enlarged character series, "A B C", is printed in the same direction (left to right) as in the printing operation of the upper half.

Thus, according to the print control in the conventional printer, those characters to be divided into a plurality of zones for their printing are printed unidirectionally. Accordingly, the print control succeeds in eliminating the problem of the discontinuity in the printed characters, which arises from the different printing directions of the printing head.

In the print control disclosed in the Unexamined Japanese Patent Publication No. Sho. 61-57348, the character images that are printed through one movement of the printing head are those characters occupying only one line. For this reason, when this print control is used to print character images of a plurality of lines in a state where these overlap in a scan zone, as viewed in the moving direction of the printing head, the number of movements of the printing head and the number of feeds of the recording paper are increased. As a result, the printing speed is decreased.

SUMMARY OF THE INVENTION

An object of the present invention is to provide a method and apparatus for controlling the movement of a printing head. It is a further object to provide a process of printing characters that are higher than the height of the printing head which nevertheless utilizes unidirectional printing It is further desired to provide a system in which character image is divided into zones for printing in consideration of the zones to record a character image of a plurality of adjacent lines, whereby the number of movements of the printing head is reduced and hence the print speed is improved.

To achieve the above object, according to the first aspect of the present invention, there is provided a method of controlling the movement of a printing head in a printer for printing characters along a print pass while selectively reversing a moving direction of the printing head, the steps of: setting at least two passes by dividing print data of a plurality of lines by the height of the printing head; searching the passes for a lowest pass containing a bottom of characters of a first line in the print data; checking whether or not a top of characters of a second line in the print data is present in the passes from an uppermost pass containing a top of the characters of the first line in the print data to the lowest pass; continuing to print the characters of the second line in a first direction as the characters of the first line are printed if the top of the characters of the second line is present in the passes from the uppermost pass to the lowest pass; and reversing the moving direction of the printing head for continuing to print the characters of the second line in a second direction opposite to the first direction if the top of the characters of the second line is absent in the passes from the uppermost pass to the lowest pass.

According to the second aspect of the present invention, there is provided a method for controlling the movement of a printing head in a printer for printing characters along a print pass while reversing the moving direction of the printing head, including the steps of: setting at least two passes by dividing print data of a plurality of lines by the height of the printing head; searching these passes for the lowest pass containing the bottom of the characters of the first line in the print data; checking whether or not the top of the character of the second and subsequent lines in the print data is present in the passes from the uppermost pass to the lowest pass; and if the top of the character of the second and subsequent lines is present, searching for the lowest pass containing the bottom of that character and continuing to print in the same direction until the lowest pass is reached.

According to the third aspect of the present invention, there is provided an apparatus for controlling the movement of a printing head in a printer for printing characters along a print pass while selectively reversing a moving direction of the printing head, including an image dividing device for setting passes by dividing print data of a plurality of lines by the height of the printing head; a first determining device for determining whether or not a bottom of characters of a first line in the print data is contained in the passes set by the image dividing device; a second determining device for checking whether or not a top of characters of a second line is contained in the passes from an uppermost pass containing a top of the characters of the first line to a lowest pass containing the bottom of the characters of the first line determined by the first determining device; and a control device for controlling the movement of the printing head so as to print the characters of the first and second lines while moving the printing head in a first direction if the second determining device determines that the top of the characters of the second line is contained.

According to the fourth of the present invention, there is provided an apparatus for controlling the movement of a printing head in a printer for printing characters along a print pass while selectively reversing a moving direction of the printing head, including an image dividing device for setting passes by dividing print data of a plurality of lines by the height of the printing head; a first determining device for determining whether or not a bottom of characters of a first line in the print data is contained in the passes set by the image dividing device; a second determining device for checking whether or not a top and a bottom of characters of a second line are contained in the passes from an uppermost pass containing a top of the characters of the first line to a lowest pass containing the bottom of the characters of the first line determined by the first determining device in a pass containing the bottom of the characters of the first line determined by the first determining device; and a control device for controlling the movement of the printing head so as to print the characters of the first and second lines while moving the printing head in a first direction until the second determining device determines that the bottom of the characters of the second line is contained if the second determining device determines that the top of the characters of the second line is contained.

In the present invention, the determining devices scan the print data of a plurality of lines to check a relationship of a distribution value of the height of a character contained in the print pass and the height of the printing head. If the distribution value of the height of the character contained in the print pass is larger than or equal to the height of the printing head, the control device causes the printing head to repeatedly move in the same direction for printing the character. If the distribution value of the height of the character contained in the print pass is smaller than the height of the printing head, the control device reverses the moving direction of the printing head for printing the character.

Also, in an array of characters in which the bottoms of the characters are different but the characters are contained in the same print pass, the characters are printed in the same direction. After the character terminates, the printing direction is reversed.

DESCRIPTION OF THE PREFERRED EMBODIMENTS

Figure 1:
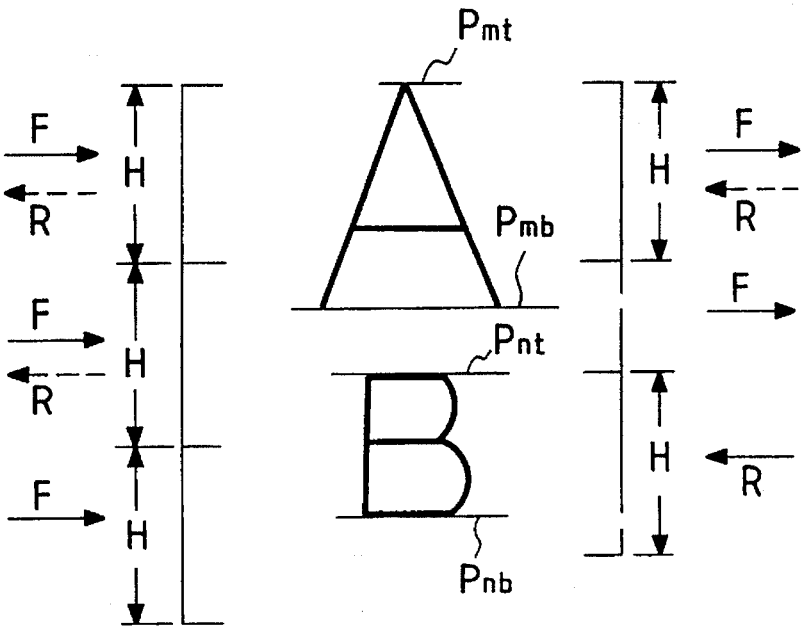
FIG. 1 is an explanatory diagram showing a first example of the movements of a printing head according to the present invention.

FIG. 1 is one diagram showing the movement of a printing head according to the present invention. In this first example of FIG. 1, characters "A" and "B", located at the center of the illustration, are different in size and located on different lines on a recording paper, i.e., on different base lines. In the first example, the character "A" is printed on the m-th line, and the character "B" is printed on the n-th line. The top and the bottom of the character "A" are denoted as Pmt and Pmb, respectively. The top and the bottom of the character "B" are denoted as Pnt and Pnb, respectively.

The printing head for printing these characters has the height of H. Since the height of the character "B" on the n-th line is smaller than the height H of the printing head, the character "B" can be printed by moving the printing head only one time. The height of the character "A" on the m-th line is larger than the height H of the printing head. In this case, one movement of the printing head can print only a part of the character "A". To print the whole character "A", the unidirectional movement of the printing head is repeated.

A case where a first image division method of the present invention is applied to the printing of these characters thus arrayed will be described. The whole image including the characters "A" and "B" of the m-th and n-th lines, as illustrated in the left side in FIG. 1, are equally divided into three scan zones, by the height H of the printing head. In the first scan zone, the printing head is moved for a first printing in the forward direction F, and returned to the initial position. Then, the printing head is moved again in the forward direction F, for a second printing. By this sequence of movements of the printing head, the remaining part of the character "A" and the upper half of the character "B" are printed. Subsequently, the printing head is moved in the reverse direction R to the initial position, and then moved in the forward direction F for a third print. Thus, this first image division method requires three forward movements F of the printing head for printing the characters "A" and "B". To complete the print of these characters, the printing head is moved totally five times, three times for the forward movement F and two times for the reverse movement R.

A second image division method of the present invention is illustrated on the right side of FIG. 1. As shown, a division point is set at the top Pnt of the character "B". The second image division method can reduce the total number of the movements of the printing head to four. The second image division method is the same as the first image division method in that the image division starts from the top Pmt of the character "A", but is different in that the next division does not start until the top Pnt of the character "B" is reached. A third image division starts from the top Pnt of the character "B". As shown, the character "B" is lower than the printing head. Therefore, the character "B" can be printed by one movement of the printing head. For the reasons described in the Background discussion, returning movement of the printing head is not required for printing this character.

The second image division method can print the image including the characters "A" and "B" in two forward movements, and one reverse movement R. Thus, the total number of movements of the printing head is one less than required by the first image division method. The printing speed is also correspondingly increased.

Figure 2:
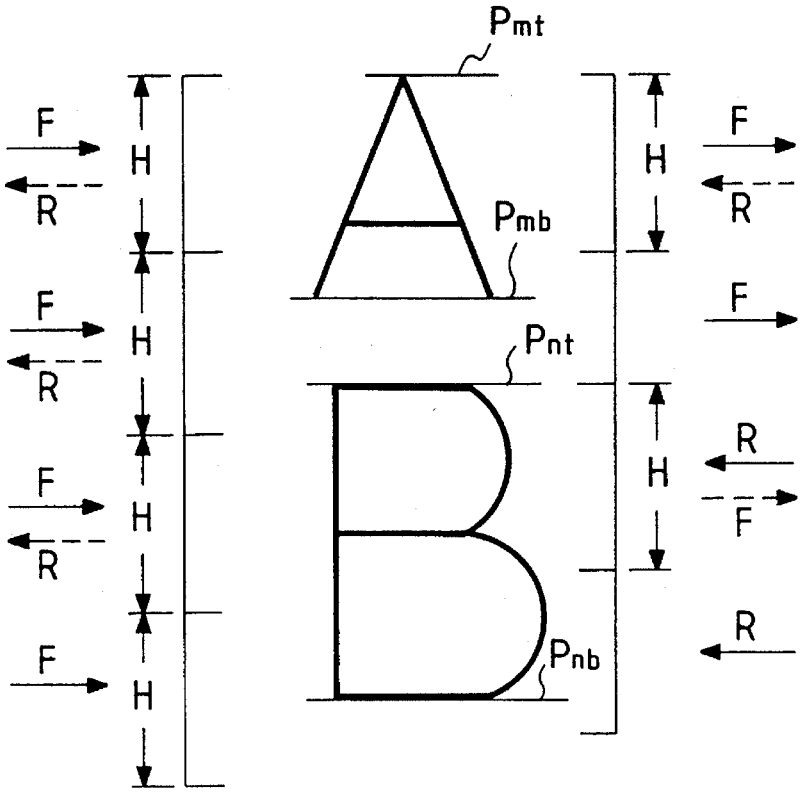
FIG. 2 is an explanatory diagram showing a second example of the movements of a printing head according to the present invention.

In a second example, illustrated in FIG. 2, the characters "A" and "B" are both higher than the height H of the printing head. Accordingly, two printing operations are required for each character. When the first image division method is applied in printing these characters, the printing of the character "A" is completed after the second forward movement, as illustrated on the left side in FIG. 2. To print the character "B", second to fourth forward movements, three forward movements in total, are required. In the second forward movement, a lower part of the character "A" and an upper part of the character "B" are printed concurrently. Therefore, it is impossible to change the printing direction. Accordingly, the printing head must be moved reciprocally, with the return of the printing head interleaved therebetween. To complete the printing of the image including the characters "A" and "B", a total of seven movements is required.

In the second example of FIG. 2, the second image division method of the present invention is illustrated on the right side in FIG. 2. In a case where the division point is set at the top Pnt of the character "B", only six forward and reverse movements are required. A large upper part of the character "A" is printed during the forward movement F of the printing head. After the printing head is returned to the original position, the remaining part of the character "A" is printed in the second forward movement F.

Substantially the upper half of the character "B" is printed through the second reverse movement R of the printing head. With the third forward movement F, the printing head is moved to the right side position. The third reverse movement R of the printing head is used for printing substantially the lower half part of the character "B". In this way, a total of six movements of the printing head completes the printing of the whole image of the characters "A" and "B".

Figure 3:
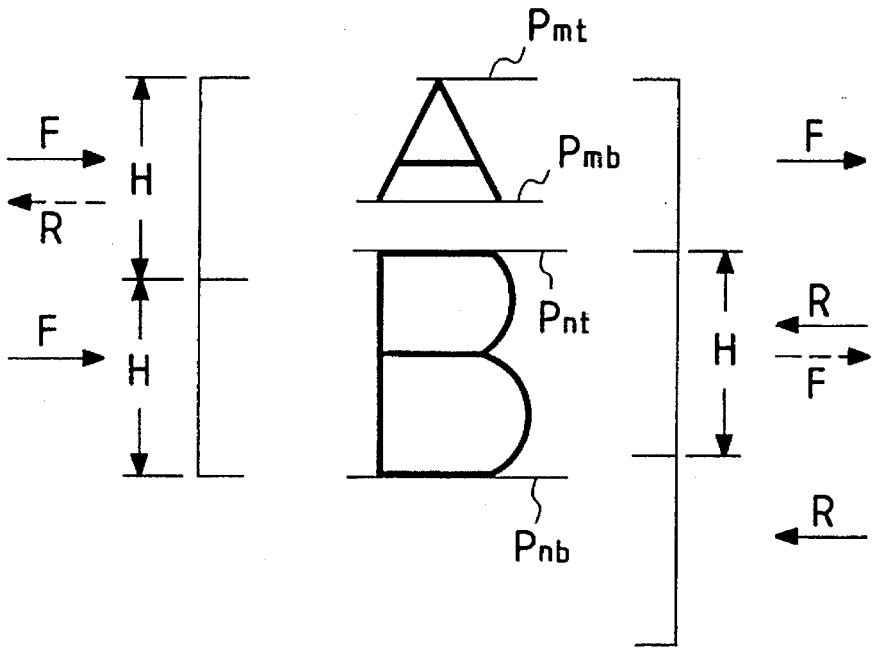
FIG. 3 is an explanatory diagram showing a third example of the movements of a printing head according to the present invention.

FIG. 3 shows a third example, for printing another image. The second image division method requires a larger number of movements of the printing head than the first image division method, for printing this particular image.

In this image, the height of the character "A" is less than the height H of the printing head. The zone of the height H of the printing head, which includes the character "A", contains the upper part of the character "B". The remaining part of the character "B" is printed by the second forward movement F of the printing head. Accordingly, the first forward movement F of the printing head prints the whole character "A" and a part of the character "B". After the printing head is returned to the original position, the printing head is moved in the forward direction F to complete the printing of both the characters. In this case, a total of three movements of the printing head is required to complete the printing of the whole image.

In a case where the second image division method is used for printing the image shown in FIG. 3, as seen from the right side illustration of FIG. 3, the zone including the whole character "A" and the top Pnt of the character "B" is printed by the first forward movement F of the printing head. Two reverse movements R of the printing head are then used for printing the zone ranging from the top of the character "B" to the bottom thereof. This printing process includes two forward movements F and two reverse movement S/R. Accordingly, a total of four movements of the printing head is required.

Figure 4:
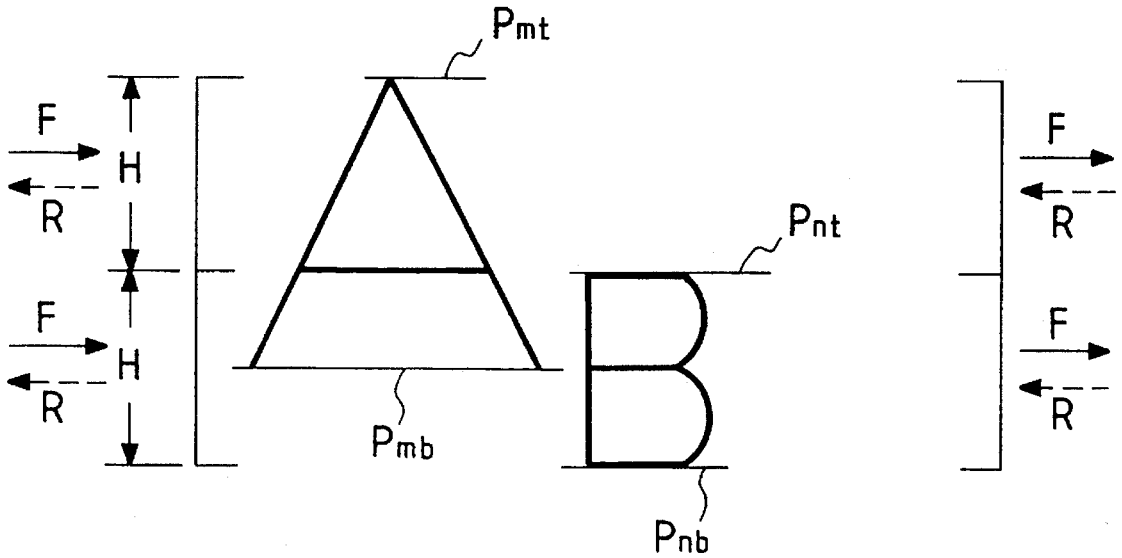
FIG. 4 is an explanatory diagram showing a fourth example of the movements of a printing head according to the present invention.

FIG. 4 shows a fourth example for printing still another image. In the fourth example, a character "A" and a character "B" are arrayed such that these characters are located on different base lines belonging to different print lines but partially overlap when viewed in the direction of printing head movement. This image is different from those images of FIGS. 1 to 3 in that the top Pnt of the character "B" is higher than the bottom Pmb of the character "A". To print this image, the number of movements of the printing head required for the first image division method is equal to that for the second image division method. Also in the fourth example, the movement of the printing head is controlled as in the examples of FIGS. 1 to 3.

As seen from FIGS. 1 to 4, the first and second image division methods of the present invention each have their respective advantages. Accordingly, these image division methods are preferably selected in accordance with the type of images to be printed.

Figure 5:
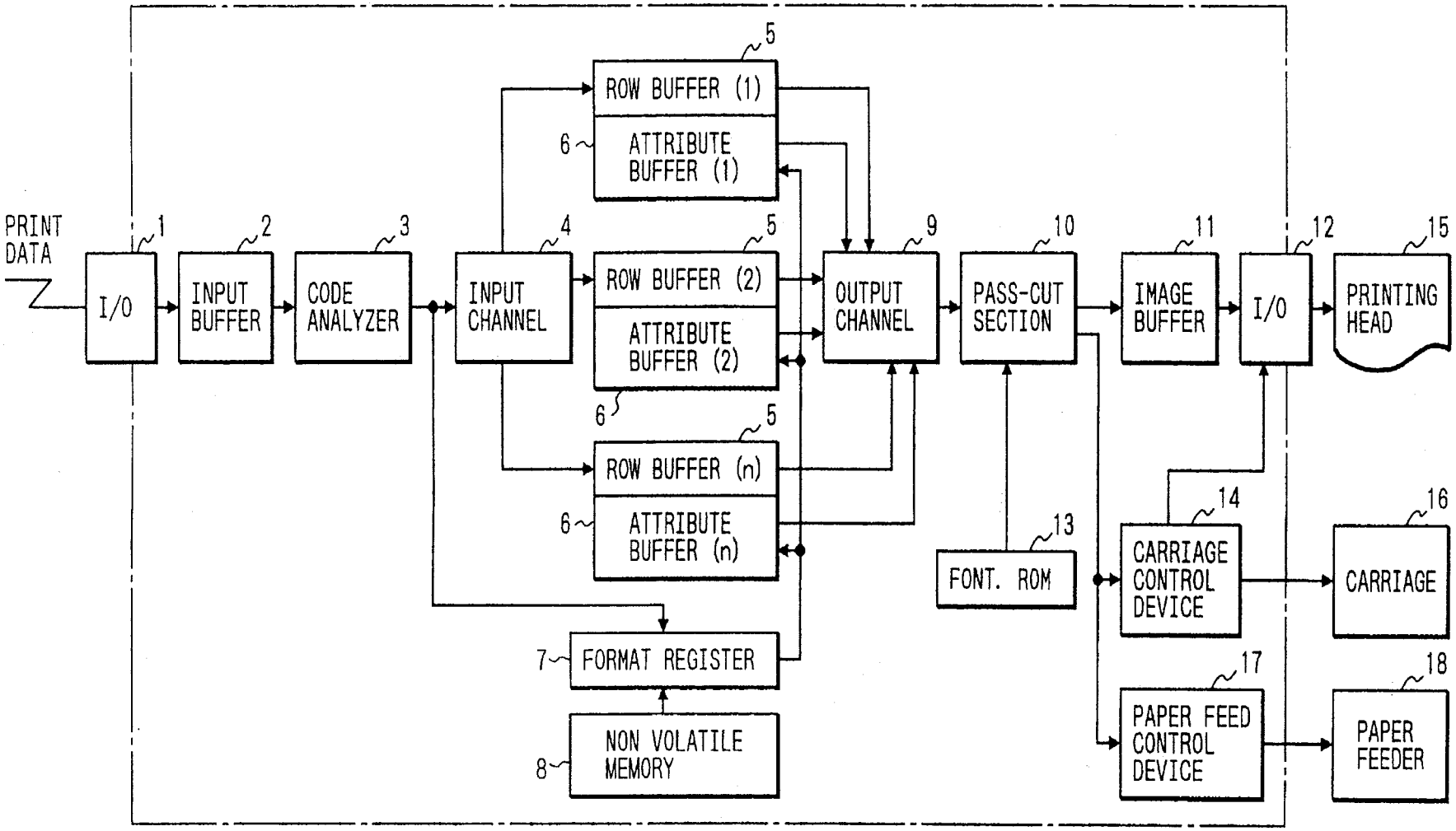
FIG. 5 is a block diagram showing an arrangement of an apparatus for controlling the movement of a printing head according to the present invention.

FIG. 5 is a block diagram showing an arrangement of a control device for controlling the movement of a printing head of a printer according to the present invention. The control device controls the forward and backward movements of a printing head, and controls the feed of a print paper on the basis of print data received from a computer or the like.

A portion enclosed by a one-dot chain line in FIG. 5 illustrates signal processing by a CPU in the control device. Print data received from the computer is loaded into an input buffer 2, through an I/O port 1 of the CPU. Then, the print data is transferred to a code analyzer 3 where characters to be printed are read out. The readout result is loaded through an input channel 4 into any of row buffers 5, that are empty. The data representative of type face, character size, and the like is loaded into a format register 7.

The row buffers 5 contain attribute buffers 6, respectively. Print positions (the top pt and the bottom pb) of characters to be printed on a print paper, which are calculated according to the character size now set in the format register 7 are loaded into the attribute buffers 6. In the initial setting mode at the time of power on, an initial value is read out of a nonvolatile memory 8 and loaded into the format register 7. Thereafter, the value in the format register 7 is altered in response to an alter command issued from the computer.

The contents stored in the row buffers 5 and the attribute buffers 6 are read out onto an output channel 9 and are applied to a pass-cut section 10. The pass-cut section 10 calculates the number of movements of a printing head, which is necessary for the pass cutting of an image as described referring to FIGS. 1 to 3, and determines an optimum pass cutting on the basis of the calculation result. The pass-cut section 10 develops the image data contained in a print pass, which is determined on the basis of the character font read out of a font ROM 13, into an image buffer 11, and sends signals to a carriage control device 14 and a paper feed control device 17 for starting to print.

When the carriage control device 14 starts up and a scan by a printing head starts, the image buffer 11 transfers its output signal through an I/O port 12 to a printing head 15, at proper timings.

Until all of the characters to be printed stored in the row buffer 5 have been printed, the carriage control device 14 controls a carriage 16 to reciprocally move the printing head 15, and a paper feeder 18 feeds a paper according to the image pass by the paper feed control device 17.

Figure 6:
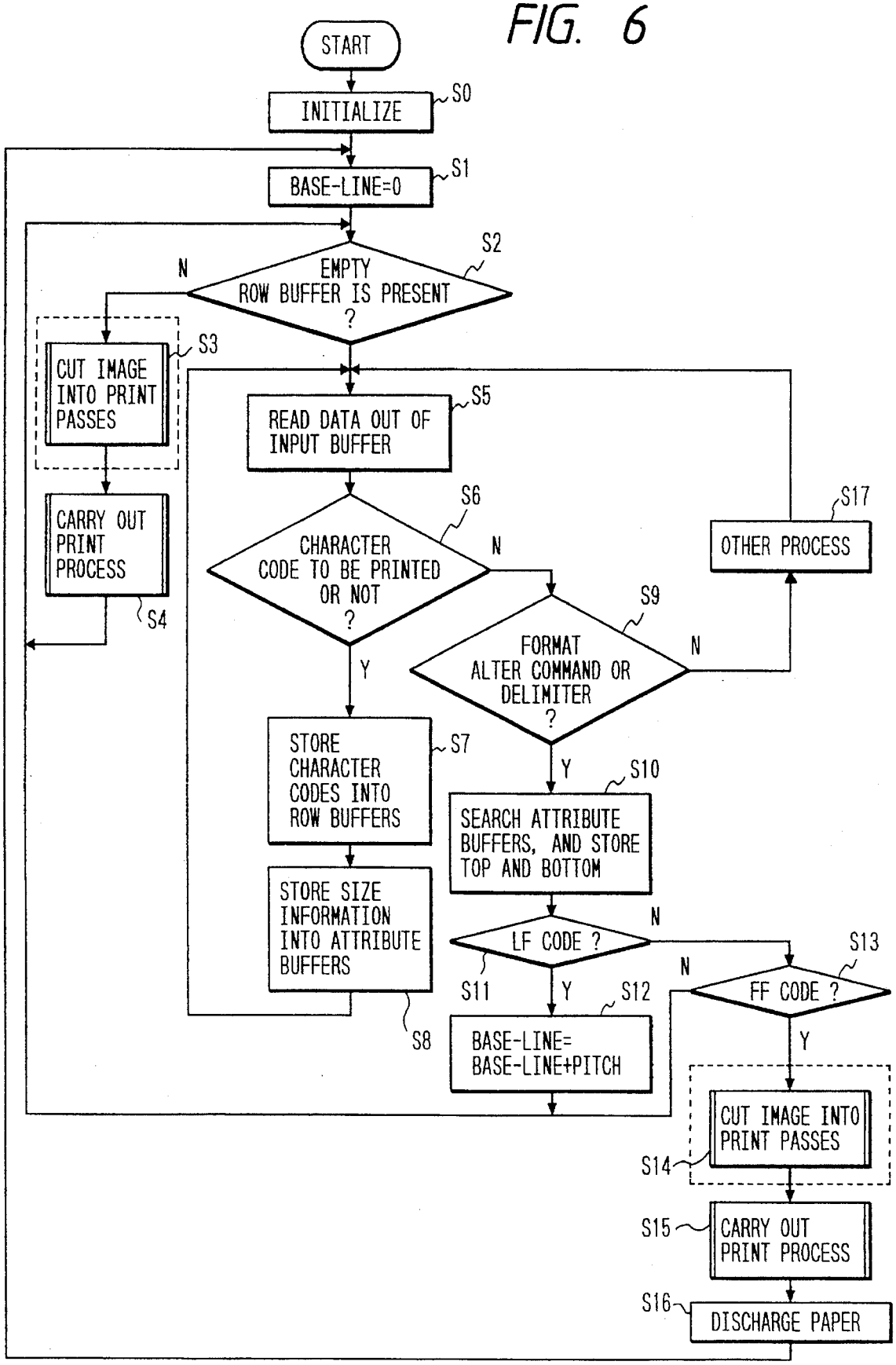
FIG. 6 is a flow chart showing a control flow by the apparatus shown in FIG. 5.

FIG. 6 is a flow chart showing an overall control by the control device arranged as shown in FIG. 5. The control follows. Upon power on, in a step SO, the respective sections in the control device are initialized.

Specifically, the input buffer 2, the row buffers 5 and the attribute buffers 6 to which the data from the input buffer 2 is loaded, the format register 7, the pass-cut section 10, the image buffer 11, and the like are initialized. In a step S1, a print paper is supplied to the printer, and a base line is set to 0. The base line provides a reference level in the height of the printed character.

To enter a process to analyze the print data which has come through the I/O port 1 from the computer and been stored in the input buffer 2, and to load the one-line print data up to CR, LF, or FF code as a delimiter into one of the row buffers 5, in a step S2, the input channel 4 searches the row buffers 5 for an empty buffer and specifies the buffer into which the one-line print data is to be loaded.

After the row buffer 5 to store the data is specified, data is read out of the input buffer 2 in a step S5, and the code analyzer 3 checks as to whether or not the print data is a character code to be printed, in a step S6. If the print data is a character code to be printed, control by the CPU flows to a step S7 where the print data is loaded into the row buffer 5 that is specified in the step S2, and to a step S8. In the step S8, the CPU calculates the positions of the top pt and the bottom pb of an image of the printed character that is stored in the row buffer 5, using the character size now stored in the format register 7 and the present base line, stores these positions in its associated attribute buffer 6, and returns its control to the step S5. In this step, the CPU reads out the next data from the input buffer 2.

If the CPU decides, in the step S6, that the print data is not a character code to be printed, then control by the CPU skips to a step S9. In this step S9, the CPU checks whether or not the code is CR (carriage return), LF (line feed), or FF (form feed) as a delimiter.

If it is not a delimiter, for example, it is a format value (e.g., character size) alter command, then control by the CPU advances to a step S17 where the process of the command is executed, and returns to the step S5 for reading out the next data.

Figures 10, 11:
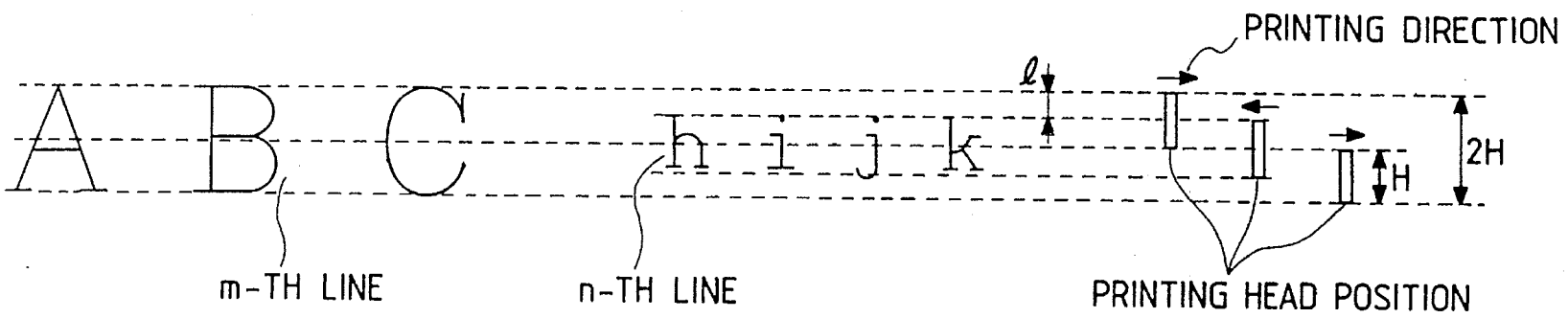
FIG. 10 is a structure of an array formed in a memory of the apparatus shown in FIG. 5.
FIG. 11 is a diagram useful in explaining an image division process employed by a conventional printer.

If the CPU decides, in the step S9, that the code is a delimiter, then the CPU retrieves the top pt and the bottom pb of each character image to be printed that is stored in the attribute buffer 6, and stores the retrieved data as the top pmt and the bottom pmb in the memory locations Pt[m]and Pb[m] in an array or table of a memory (not shown) (step S10), in order to distinctly show the maximum height of the character series to be printed on the present line. FIG. 10 shows a diagram showing the structure of the array. As shown, the top pmt and the bottom pmb are stored in the memory locations arrayed as shown, which are specified by a relative address m (column number).

Returning to FIG. 6, if the delimiter is a LF code which is a paper feed command, the CPU updates the base line in a step S12 and returns its control to the step S2. In a step S13, if the CPU determines that it is a CR code as a carriage return command, it returns its control to the step S2 where the CPU executes the loading of the print data again.

After all of the buffers 5 are loaded with the data in the control stage where the CPU returns its control to the step S2, the CPU investigates the print data that is stored in all the row buffers 5 for a pass cut of an image (image division) which minimizes the number of carriage movements (step S3), and executes a print process according to the result of the pass cut in a step S4. After all of the row buffers 5 are empty, control by the CPU returns to the step S2. Then, the CPU repeats the sequence of above-mentioned control steps again.

When the CPU determines that the delimiter is a FF code as a page break command in the step S13, the CPU executes a pass cut process on only the data thus far stored (step S14), executes a printing process on the basis of the result of executing the pass cut process (step S15), and discharges the print paper out of the printer (step S16). Then, the CPU returns its control to the step S1 where the next paper is moved to the print start position and the base line is set to zero.

The details of the pass cutting process in the steps S3 and S14 will be described with reference to FIGS. 7 and 8.

Figure 7:
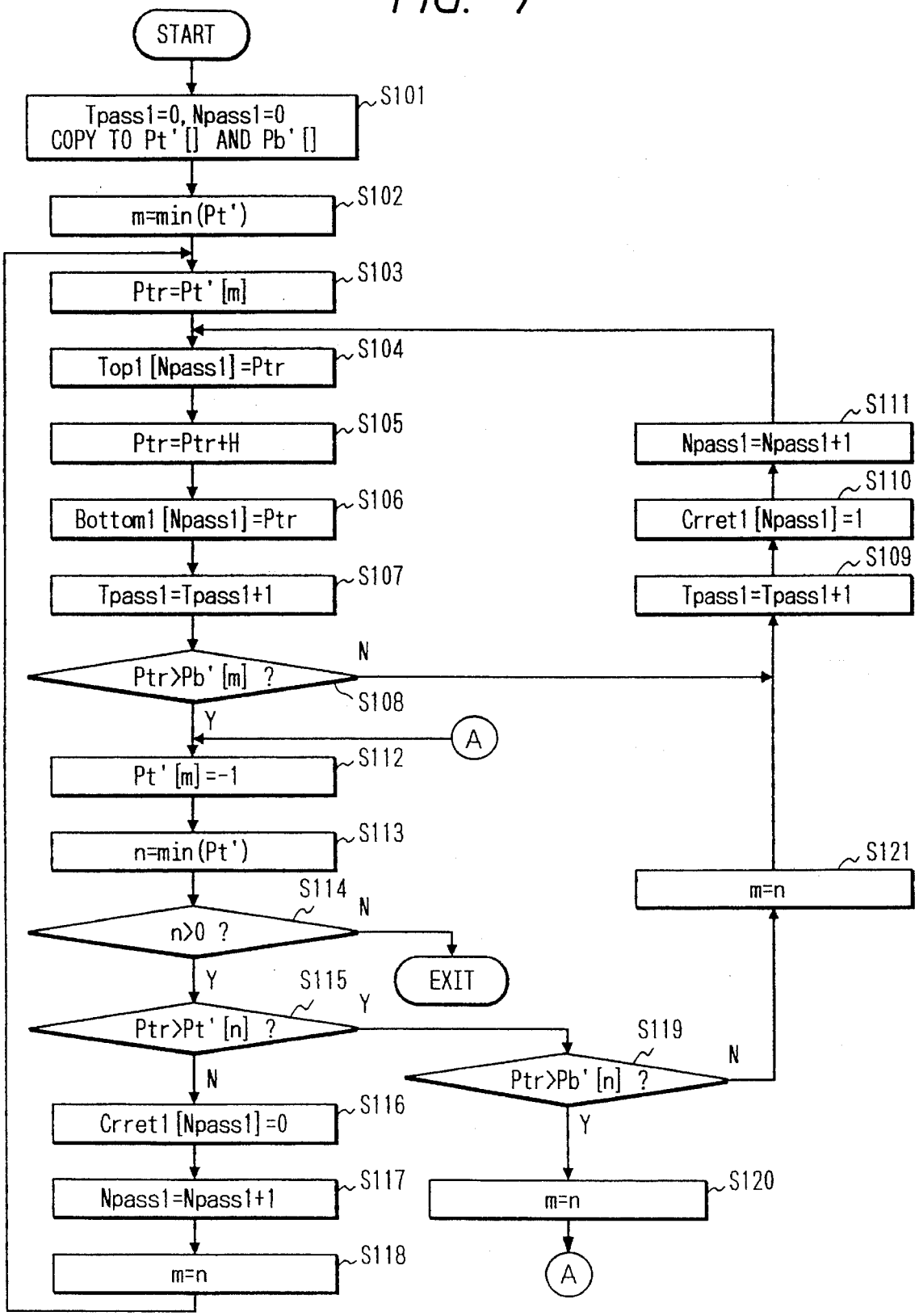
FIG. 7, is a flow chart showing a control flow when the apparatus divides an image by a first image division method according to the present invention.
Figure 8:
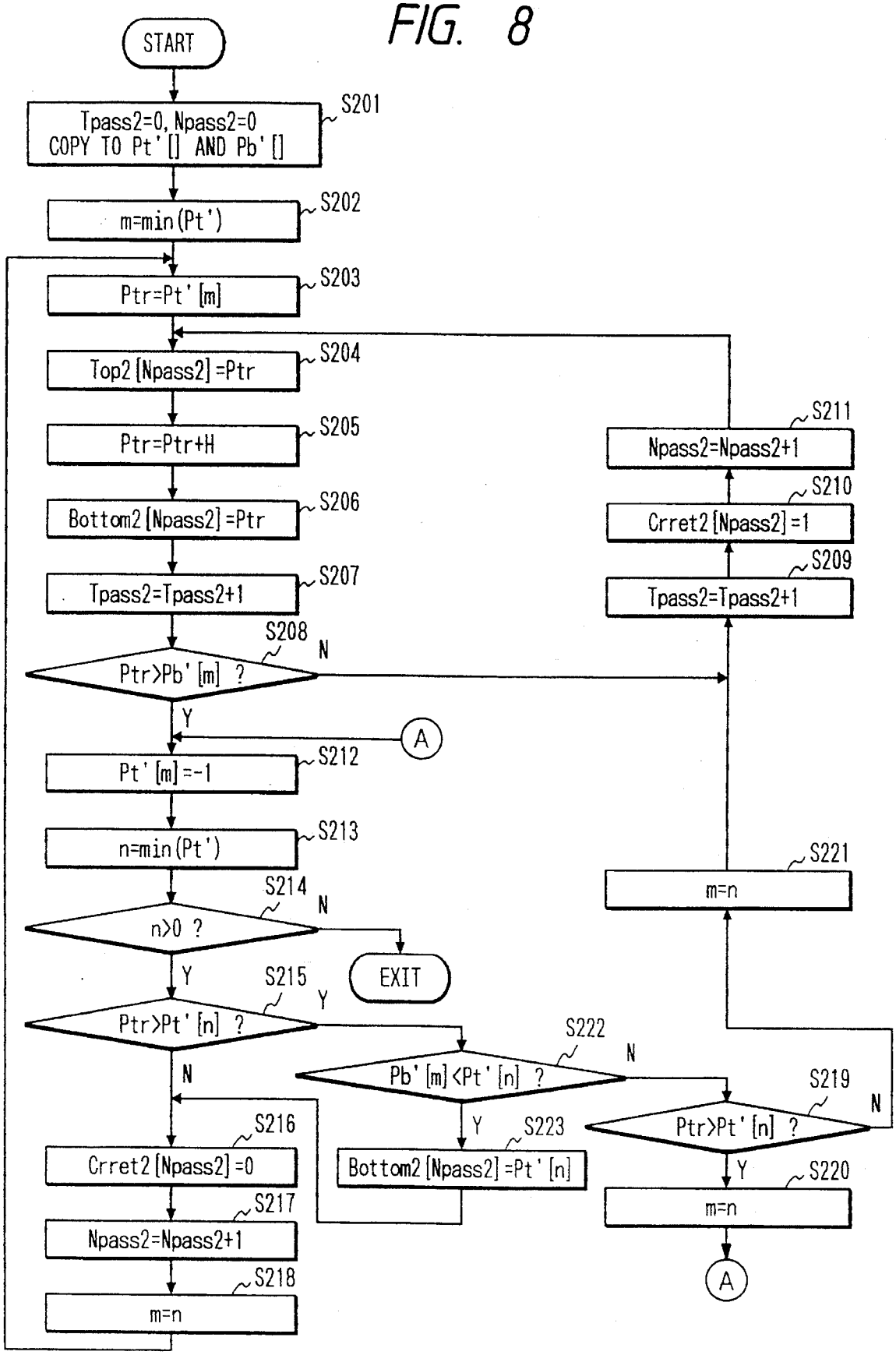
FIG. 8 is a flow chart showing a control flow when the apparatus divides an image by a second image division method according to the present invention.

FIGS. 7 and 8 show process flows to set passes on an image by the first and second image division methods and to obtain the number of movements of a printing head, which results from the image division. These process flows are carried out in the steps S3 and S14 in the flow chart shown in FIG. 6.

In the flow chart shown in FIG. 7, the CPU initializes a counter Npass1 for counting the number of division passes and a counter Tpass1 for counting the number of movements of a printing head, in a step S101. Further, it copies the array Pt[] and Pb[], which stores the tops and the bottoms of the character series of each line, as an array Pt'[] and Pb'[], in a work area of the memory.

The CPU searches the tops in each row for the row number m located in the highest level on the paper (S102). A function min(Pt') is for returning the row number of the smallest positive value of those numbers in the array Pt'[], i.e., the row number of the value located in the highest level on the paper of those tops stored in the array. In a case where the tops stored are all negative, the function returns a negative value as an error.

To set a division start point at the top Pt'[m] of the row m gained in the step S102, the top Pt'[m] is set to a pointer (referred to as Ptr) (step S103).

In steps S104 to S106, the CPU divides an image in the row m in the width of the height H of the printing head (the image division starts from the Ptr position), and stores the position of the division pass on the paper, in association with the Npass1. Top1[] and Bottom [], used here, also indicate arrays formed in the memory. In the array, the Npass1 indicating the division pass number is used as a relative address. The arrays indicate the upper and the lower limits of a division zone.

After the division pass is determined, the printing head must be moved for one scan. To this end, the Npass1 indicating the division pass number must be incremented by 1 (+1) (step S107). To check whether or not the images in the row m, now being processed, have all been divided, the CPU compares the present Ptr with the bottom Pb'[m] in the row m (step S108).

If an image not yet divided is left in the row m, the CPU adds a movement caused by the carriage return to the Tpass1 (step S109) since the image must be printed in a unidirectional manner. The CPU stores an identification code (1) indicating that the carriage return command is required into an array Crret1[] in association with the Npass1 (step S110). Further, the CPU increments the Npass1 (step S111) by one (+1), and returns its control to the step S104.

If in a step S108, the CPU determines that all of the images in the row m being currently processed have been divided, then control by the CPU advances to a step S112. In this step, the CPU erases the top of the image in the processed row m(Pt'[m]=−1) by changing its value to a value which does not exist on the paper, e.g., a negative value, thereby updating the array Pt'[].

In a step S113, the CPU searches the updated array Pt'[]for the row number n having the top located in the highest level on the paper. And in a step S114, the CPU checks if the row number n is positive or negative. If it is a negative number as an error value, the CPU ends and exits from the present process since the negative value indicates that the image division of the characters to be printed, that are stored in the row buffers 5, is completed. Usually, the CPU advances its control to a step S115 where it compares the present Ptr value with the top Pt' of the row n gained in the step S113. If the present Ptr value is higher in level than the top Pt'[n] of the row n, that is, the tops in the n row reach the pass thus far divided, then control by the CPU steps forward to a step S119. In this step, the CPU checks whether or not the present Ptr value is larger than the bottom Pb'[n] in the row n. If the present Ptr value is larger than the bottom Pb'[n] in the row n, that is, all of the images in the n row are contained in the divided pass, then the CPU substitutes n into (step S120), and erases the top data in the row n in a step S112.

If the present Ptr value is smaller than the bottom Pb'[n] in the step S119, that is, the upper part of the image in the row n reaches the already divided pass but the lower part of the image is not yet divided into a zone (FIGS. 1 to 4), then the CPU substitutes n into m (m=n) in a step S121, and then advances its control to the step S109 for the unidirectional printing. In this step, the previously stated process is repeated.

Returning to the step S115, if the present Ptr value is smaller than the top Pt'[n] in the row n, that is, there is a relatively large space between the rows m and n so that no carriage return is required for the printing of the subsequent division pass, then the CPU stores an identification code (0) indicating that no carriage return is required into the array Crret1[] in association with the Npass1 indicating the division pass number (step S116). In the next step S117, the CPU increments the Npass1 by one (+1).

To repeat the process starting from the step 103 in a state that the row number n gained in the step S113 is replaced by a new row m (step S118), the CPU substitutes the row number n into the row number m, and returns its control to the step S103.

Through the process thus far described, the pass areas and the number of movements of the printing head that are based on the first image division method of the present invention can be obtained.

A flow chart shown in FIG. 8 will be described.

The flow chart of FIG. 8 is different from the flow chart of FIG. 7 in that the former has an additional process (steps S222 to S223). In the process, the CPU checks whether or not any space is present between the rows m and n, and if it is present, changes the content of the division Ptr to the top of the next row.

Firstly, in a step S201, the CPU initializes a counter Npass2 for counting the number of division passes and a counter Tpass2 for counting the number of movements of a printing head. Further, it copies the array Pt[] and Pb[], which stores the tops and the bottoms of the character series of each line, as an array Pt'[] and Pb'[], in a work area of the memory.

The CPU searches the tops of each row for the row number m located in the highest level on the paper (S202).

To set a division start point at the top Pt'[m] of the row m gained in the step S202, the top Pt'[m] is set to a pointer Ptr (step S203).

In steps S204 to S206, the CPU divides an image in the row m in the width of the height H of the printing head (the image division starts from the Ptr position), and stores the position of the division pass on the paper, in association with the Npass2. Top2[] and Bottom2[], used here, also indicate arrays formed in the memory. In the array, the Npass2 indicating the division pass number is used as a relative address. The arrays indicate the upper and lower limits of a division pass.

After the division pass is determined, the printing head must be moved for one scan. To this end, the Npass2 indicating the division pass number must be incremented by one (+1) (step S207). To check whether or not the images in the row m, now being processed, have all been divided, the CPU compares the present Ptr with the bottom Pb'[m] in the row m (step S208).

If an image not yet divided is left in the row m, the CPU adds a movement caused by the carriage return to the Tpass2 (step S209) since the image must be printed in a unidirectional manner. The CPU stores an identification code (1) indicating that the carriage return command is required into an array Crret2[] in association with the Npass1 (step S210). Further, the CPU increments the Npass2 (step 211) by one (+1), and returns its control to the step S204.

If in a step S208, the CPU determines that all of the images in the row m being currently processed have been divided, then control by the CPU advances to a step S212. In this step, the CPU erases the top of the image in the processed row m(Pt'[m]=−1) by changing its value to a value which does not existing on the paper, e.g., a negative value, thereby updating the array Pt'[]. In a step S213, the CPU searches the updated array Pt'[] for the row number n having the top located in the highest level on the paper. And in a step S214, the CPU checks if the row number n is positive or negative. If it is a negative number as an error value, the CPU ends and exits from the present process since the negative value indicates that the image division of the characters to be printed, that are stored in the row buffers 5, is completed. Usually, the CPU advances its control to a step S215 where it compares the present Ptr value with the top Pt'[n] of the row n gained in the step S213.

If the present Ptr value is not higher in level than the top Pt'[n] of the row n, that is, there is a relatively large space between the rows m and n so that no carriage return is required for the printing of the subsequent division pass, then the CPU stores an identification code (0) indicating that no carriage return is required into the array Crret2[] in association with the Npass2 indicating the division pass number (step S216). In the next step S217, the CPU increments the Npass2 by one (+1).

To repeat the process starting from the step 203 in a state that the row number n gained in the step S213 is replaced by a new row m(step S218), the CPU substitutes the row number n into the row number m, and returns its control to the step S203.

The process thus far described is substantially the same as that in the first image division method.

If the present Ptr value is larger than the top Pt'[n] in the row n in the step S215, the CPU advances its control to a step S222, which is the feature of the second image division method. In this step, the CPU compares the bottom Pb'[m]in the row m division processed with the top Pt'[n] in the row n to be division processed.

If in the step S222, the bottom Pb'[m] is smaller than the top Pt'[n], that is, there is a space between the rows m and n, then the CPU advances its control to a step S223. In this step, it changes the lower limit Bottom2[Npass2] of the pass resulting from the latest image division to the top Pt'[m] in the row n, and executes the steps S216 to S218, and returns its control to the step S203. In this step, the CPU sets the top of the next line to the division Ptr.

If the Pb'[m] is larger than Pt'[n] in the step S222, the images in the rows m and n partially overlap as viewed in the moving direction of the printing head. Accordingly, the CPU advances its control to a step S219. In this step, the CPU checks whether or not the present Ptr value is larger than the bottom Pb'[n] in the row n. If the present Ptr value is larger than the bottom Pb'[n] in the row n, that is, all of the images in the row n are contained in the already divided pass, then the CPU substitutes the row number n into the row number m(m=n) in the step S220, and erases the top data in the row n in the step S212.

If the present Ptr value is smaller than the bottom Pb'[n] in the row n in the step S219, that is, the upper part of the image in the row n reaches the already divided pass but the lower part of the image is not yet divided into a zone (FIG. 4), then the CPU substitutes n into m(m=n) in a step S121, and advances its control to the step S109 for the unidirectional printing. In this step, the previously stated process is repeated.

Through the process thus far described, the pass areas and the number of movements of the printing head that are based on the second image division method of the present invention can be previously obtained.

Figure 9:
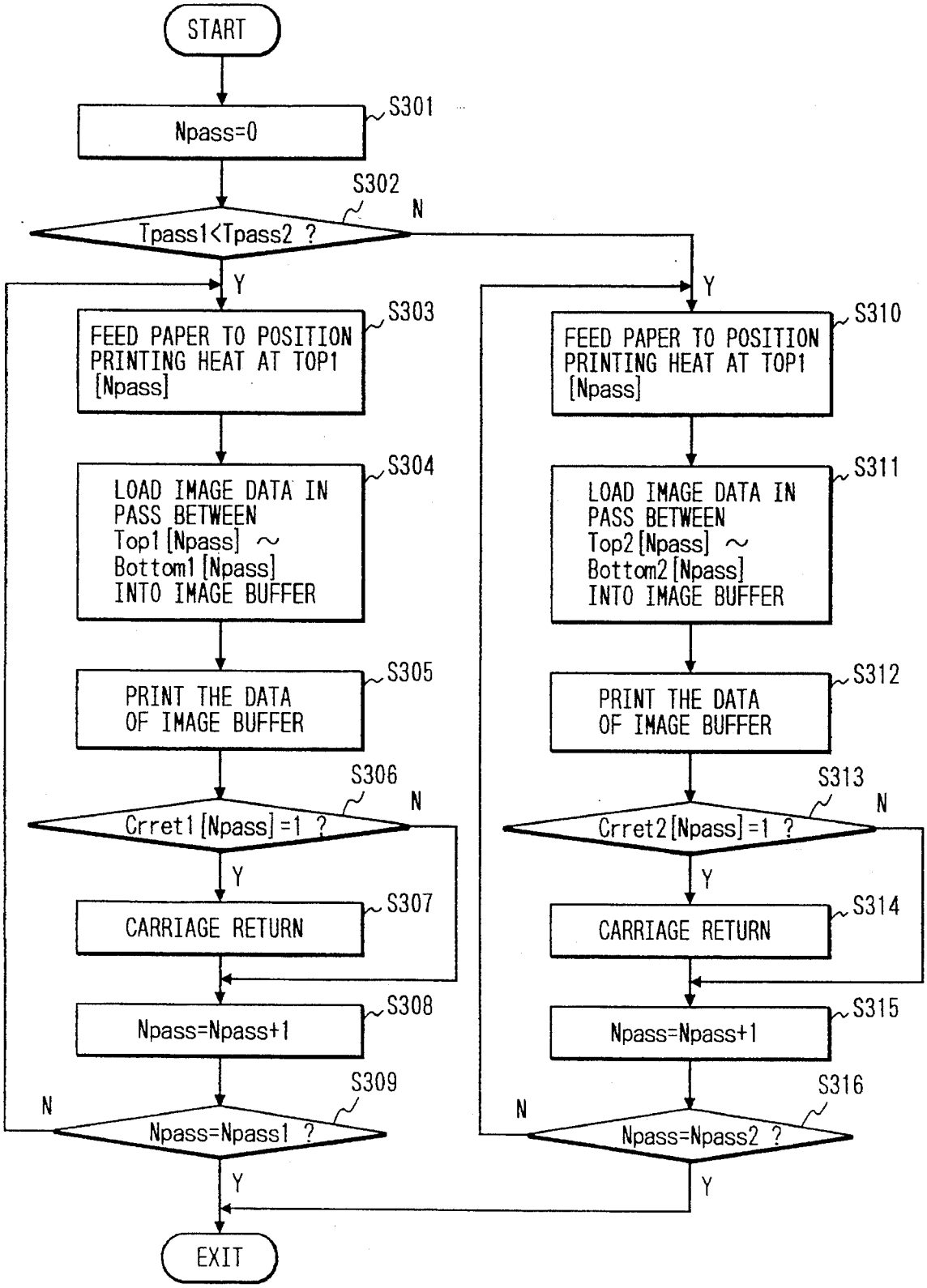
FIG. 9 is a flow chart showing a printing process by the apparatus shown in FIG. 5.

The printing process of the steps S4 and S15 in the flow chart of FIG. 6 will be described with reference to FIG. 9.

In a step S301, the CPU resets the Npass indicating the division pass number to 0. In a step S302, the CPU compares the Tpass1 with the Tpass2 to check which of the first image dividing method and the second image dividing method requires a less number of carriage movements.

If the CPU determines that the first image dividing method requires a less number of the carriage movements than the second image dividing method, the CPU carries out a process consisting of steps S303 to S309.

In a step S303, the paper is fed so that the leading edge of the printing head is positioned at the Top1[Npass]. In a step S304, the CPU reads all of the image data contained in the zone of the pass of the Npass indicating the division pass number of the characters to be printed, from the row buffers 5, and loads them into the image buffer 11, and causes the printer to print the image data.

After the printing operation, the CPU determines whether or not the carriage return is required, while referring to the array element Crretl[Npass](step S306). If the Crretl[Npass] is "1", the CPU causes the carriage to return in a step S307. If the Crretl[Npass] is "0", the CPU advances its control to a step S308 where it increments the Npass by one (+1). In a step S309, the CPU compares the Npass with the Npass1. If these are coincident with each other, the CPU returns its control to the step S303, and carries out the printing process of the next division pass.

If the CPU determines, in the step S302, that a less number of the carriage movements is required by the second image dividing method than by the first image dividing method, then the CPU carries out a process consisting of steps S310 to S316. Description of this process is omitted since it is substantially the same as that of S303 to S309.

Although the structures of other arrays than the array Pmt[] and Pmb[] are not shown in the figures, those are similar to that of the array Pmt[] and Pmb[].

As described above, according to the present invention, an image division method requiring a less number of passes for the print of an image is selected through a process of searching a plurality of character series for the heights of the characters. When a character exceeding the height of a printing head is printed, the printing head is moved for printing in the same direction so long as the character continues. Therefore, a printed character, after printed, does not have discontinuity, so that the quality of the printed character is good. Further, a minimal number of reciprocal movements of the printing head is required.

What is claimed is:

1. A method of controlling the movement of a printing head in a printer for printing characters along a print pass while selectively reversing a moving direction of the printing head, comprising the steps of:

setting at least two passes of the printing head by dividing print data of a plurality of lines into passes, each corresponding to the height of the printing head;

searching the passes for a first lowest pass containing a bottom of characters of a first line in the print data;

checking whether or not a top of characters of a second line in the print data is present in the passes from an uppermost pass containing a top of the characters of the first line in the print data to the first lowest pass;

continuing to print the characters of the second line in a first direction which is the same as the characters of the first line are printed if the top of the characters of the second line is present in the passes from the uppermost pass to the first lowest pass as determined in the checking step; and reversing the moving direction of the printing head for continuing to print the characters of the second line in a second direction opposite to the first direction if the top of the characters of the second line is not present in the passes from the uppermost pass to the first lowest pass as determined in the checking step.

2. The method of claim 1, further comprising a step of searching for a second lowest pass containing a bottom of the characters of the second line if the top of the character of the second line is present in the passes from the uppermost pass to the first lowest pass, wherein the continuing step continues to print the characters of the second line in the first direction until the second lowest pass is reached.

3. A method of controlling the movement of a printing head in a printer for printing characters along a print pass while selectively reversing a moving direction of the printing head, comprising the steps of:

setting at least two passes by dividing print data of a plurality of lines into passes, each corresponding to the height of the printing head;

searching the passes for a first lowest pass containing a bottom of characters of a first line in the print data;

checking whether or not a top of characters of a second line in the print data is present in the passes from an uppermost pass containing a top of the characters of the first line in the print data to the first lowest pass;

searching for a second lowest pass containing a bottom of the characters of the second line if the top of the character of the second line is present in the passes from the uppermost pass to the first lowest pass as determined in the checking step; and continuing to print the characters of the second line in a first direction which is the same as the characters of the first line are printed until the second lowest pass is reached.

4. The method of claim 3, further comprising a step of reversing the moving direction of the printing head for continuing to print the characters of the second line in a second direction opposite to the first direction if the top of the characters of the second line is not present in the passes from the uppermost pass to the first lowest pass.

5. An apparatus for controlling the movement of a printing head in a printer for printing characters along a print pass while selectively reversing a moving direction of the printing head, comprising:

image dividing means for setting passes by dividing print data of a plurality of lines into passes, each corresponding to the height of the printing head;

first determining means for determining whether or not a bottom of characters of a first line in the print data is contained in the passes set by said image dividing means;

second determining means for checking whether or not a top of characters of a second line is contained in the passes from an uppermost pass containing a top of the characters of the first line to a first lowest pass containing the bottom of the characters of the first line determined by said first determining means; and control means for controlling the movement of the printing head so as to print the characters of the first and second lines while moving the printing head in a first direction if said second determining means determines that the top of the characters of the second line is contained in the passes from the uppermost pass to the first lowest pass.

6. The apparatus of claim 5, wherein said control means reverses the moving direction of the printing head for continuing to print the characters of the second line in a second direction opposite to the first direction unless said second determining means determines that the top of the characters of the second line is contained in the passes from the uppermost pass to the first lowest pass.

7. An apparatus for controlling the movement of a printing head in a printer for printing characters along a print pass while selectively reversing a moving direction of the printing head, comprising:

image dividing means for setting passes by dividing print data of a plurality of lines into passes, each corresponding to the height of the printing head;

first determining means for determining whether or not a bottom of characters of a first line in the print data is contained in the passes set by said image dividing means;

second determining means for checking whether or not a top and a bottom of characters of a second line is contained in the passes from an uppermost pass containing a top of the characters of the first line to a first lowest pass containing the bottom of the characters of the first line determined by said first determining means; and control means for controlling the movement of the printing head so as to print the characters of the first and second lines while moving the printing head in a first direction until said second determining means determines that the bottom of the characters of the second line is contained if said second determining means determines that the top of the characters of the second line is contained in the passes from the uppermost pass to the first lowest pass.

8. The apparatus of claim 7, wherein said control means reverses the moving direction of the printing head for continuing to print the characters of the second line in a second direction opposite to the first direction unless said second determining means determines that the top of the characters of the second line is contained in the passes from the uppermost pass to the first lowest pass.

* * * * *